US010192490B2

(12) United States Patent
Zhou

(10) Patent No.: US 10,192,490 B2
(45) Date of Patent: Jan. 29, 2019

(54) PIXEL ARRAY AND DISPLAY CIRCUIT FOR VIRTUAL REALITY WITH TWO DISPLAY MODES

(71) Applicant: EverDisplay Optronics (Shanghai) Limited, Shanghai (CN)

(72) Inventor: Xingyu Zhou, Shanghai (CN)

(73) Assignee: EVERDISPLAY OPTRONICS (SHANGHAI) LIMITED, Shanghai (CN)

( * ) Notice: Subject to any disclaimer, the term of this patent is extended or adjusted under 35 U.S.C. 154(b) by 0 days.

(21) Appl. No.: 15/689,846

(22) Filed: Aug. 29, 2017

(65) Prior Publication Data

US 2018/0102094 A1 Apr. 12, 2018

(30) Foreign Application Priority Data

Oct. 9, 2016 (CN) ..... 2016 1 0879936

(51) Int. Cl.
*G09G 3/3258* (2016.01)
*G09G 3/3233* (2016.01)
*G09G 3/3266* (2016.01)

(52) U.S. Cl.
CPC ..... *G09G 3/3258* (2013.01); *G09G 3/3233* (2013.01); *G09G 3/3266* (2013.01); *G09G 2300/0871* (2013.01); *G09G 2310/0202* (2013.01); *G09G 2310/08* (2013.01); *G09G 2330/02* (2013.01)

(58) Field of Classification Search
CPC ..... G09G 3/3258; G09G 3/3266; G09G 2310/08; G09G 2310/0202
See application file for complete search history.

(56) References Cited

U.S. PATENT DOCUMENTS

| | | | | |
|---|---|---|---|---|
| 8,035,711 | B2 | 10/2011 | Liu et al. | |
| 2014/0198085 | A1* | 7/2014 | Park | G09G 3/3233 345/207 |
| 2014/0353608 | A1* | 12/2014 | Kim | G09G 3/3233 257/40 |
| 2015/0130859 | A1* | 5/2015 | Yang | G09G 3/3233 345/690 |

FOREIGN PATENT DOCUMENTS

| | | |
|---|---|---|
| CN | 101536070 B | 1/2012 |
| CN | 103365326 B | 8/2015 |

* cited by examiner

*Primary Examiner* — Kwang-Su Yang
(74) *Attorney, Agent, or Firm* — Andrew F. Young, Esq.; Lackenbach Siegel, LLP

(57) ABSTRACT

The invention relates to the field of display, more specifically, to a pixel array and a display circuit for virtual reality. In the invention, two transistors (i.e., a third transistor and a fourth transistor) are respectively connected in parallel to two ends of the two transistors (i.e., the first transistor and the second transistor) controlled by the first enable signal, and as the enable signal accessed the first transistor and the second transistor is a line-by-line scan, and the enable signal accessed the third transistor and the fourth transistor can drive each of the display devices in the a plurality of rows of pixel circuits to be lit at the same time.

14 Claims, 10 Drawing Sheets

PIXEL ARRAY AND DISPLAY CIRCUIT FOR VIRTUAL REALITY WITH TWO DISPLAY MODES

CROSS-REFERENCE TO RELATED APPLICATIONS

The present application claims priority to and the benefit of Chinese Patent Application No. CN 201610879936.5, filed on Oct. 9, 2016, the entire content of which is incorporated herein by reference.

BACKGROUND OF THE INVENTION

1. Field of the Invention

The invention relates to the field of display, more specifically, to a pixel array and a display circuit for virtual reality with two display modes.

2. Description of the Related Art

The current pixel array generally comprises a multi-row and multi-column pixel circuit which performs a line-by-line scan using a scanning signal to drive the pixel circuit in the pixel array to display line by line. For example, the common 2T1C and 7T1C circuit architectures display the image line by line.

However, in some cases, such as in a virtual reality display circuit, the multi-line pixel circuits in the pixel array needs to be lit in one frame at the same time, that is, multiple lines are lit at the same time, while the current pixel circuit is unable to switch between multiple lines lighting at the same time and line-by-line lighting, thus the market share of the product is reduced.

If two display circuits are provided in a pixel circuit to achieve the above mentioned two display modes respectively, the cost of the pixel circuit is increased. Further, a pixel array needs to include a multi-row and multi-column pixel circuit, and the additional cost will be increased.

SUMMARY OF THE INVENTION

For the deficiencies of the prior art, the invention provides a pixel array and a display circuit for virtual reality.

The technical solution is as follows:

a pixel array with two display modes, comprising a plurality of rows of pixel circuits, the pixel circuit comprising:

a first transistor comprising a first end connected to a power supply terminal, a second end, and a control end accessed a first enable signal, a second transistor comprising a first end connected to a display device, a second end connected to the second end of the first transistor, and a control end accessed the first enable signal;

a third transistor comprising a first end connected to the power supply terminal, a second end connected to the second end of the first transistor, and a control end connected to a second enable signal; and a fourth transistor comprising a first end connected to the display device, a second end connected to the second end of the second transistor, and a control end accessed a second enable signal;

wherein, the first transistor and the second transistor are transistors of the same channel type, the third transistor and the fourth transistor are transistors of the same channel type;

the first enable signal drives the display devices in each row of the pixel circuits to light line by line, and the second enable signal which accesses each row of the pixel circuits is the same so that the second enable signal drives display devices in each row of the pixel circuits to be lit at the same time.

Preferably, the display device is an organic light emitting diode. Preferably, the first transistor and the second transistor are PMOS transistors.

Preferably, the third transistor and the fourth transistor are PMOS transistors.

Preferably, it further comprises:

a fifth transistor comprising a first end connected to the second end of the second transistor, a second end connected to the second end of the first transistor, a control end connected to the power supply terminal through a capacitor.

Preferably, it further comprises:

a sixth transistor comprising a first end connected to a cathode of the capacitor, a second end, and a control end accessed the first control signal, the capacitor comprising an anode connected to the power supply terminal;

a seventh transistor comprising a first end connected to a second terminal of the sixth transistor, a second end connected to an initial voltage power supply terminal, a control end accessed the first control signal; and an eighth transistor comprising a first end connected to the initial voltage supply terminal and a second end connected to the display device.

Preferably, the fifth transistor, the sixth transistor, the seventh transistor, and the eighth transistor are PMOS transistors.

Preferably, it further comprises:

a ninth transistor comprising a first end connected to the second end of the first transistor, a second end connected to a data signal input terminal, a control end accessed a second control signal;

a tenth transistor comprising a first end connected to the cathode of the capacitor, a second end and a control end accessed the second control signal; and an eleventh transistor comprising a first end connected to the second end of the tenth transistor, a second end connected to the second end of the second transistor, a control end of the eleven transistor accessed the second control signal.

Preferably, the ninth transistor, the tenth transistor, the eleventh transistor are PMOS transistors.

A display circuit used for virtual reality with two display modes, comprises the pixel array displayed above.

The beneficial effect of the above mentioned technical solution is:

two transistors (i.e., a third transistor and a fourth transistor) are respectively connected in parallel to two ends of the two transistors (i.e., the first transistor and the second transistor) controlled by the first enable signal, and as the enable signal accessed the first transistor and the second transistor is a line-by-line scan, and the enable signal accessed the third transistor and the fourth transistor can drive each of the display devices in the a plurality of rows of pixel circuits to be lit at the same time. By controlling the turn-on and turn-off of the four transistors, it is possible to realize two display modes, which are line-by-line lighting and multi-line lighting at the same time, therefore the display cost of circuit manufacturing is saved and the market share is improved.

BRIEF DESCRIPTIONS OF THE DRAWINGS

The accompanying drawings, together with the specification, illustrate exemplary embodiments of the present disclosure, and, together with the description, serve to explain the principles of the present invention.

Figure 5A:
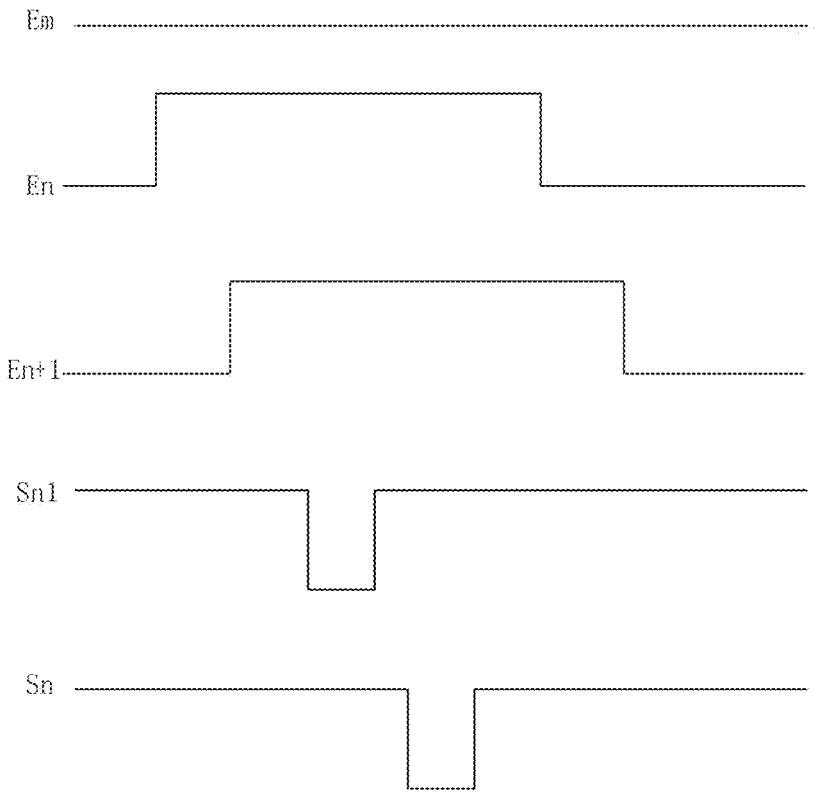
Figure 5B:
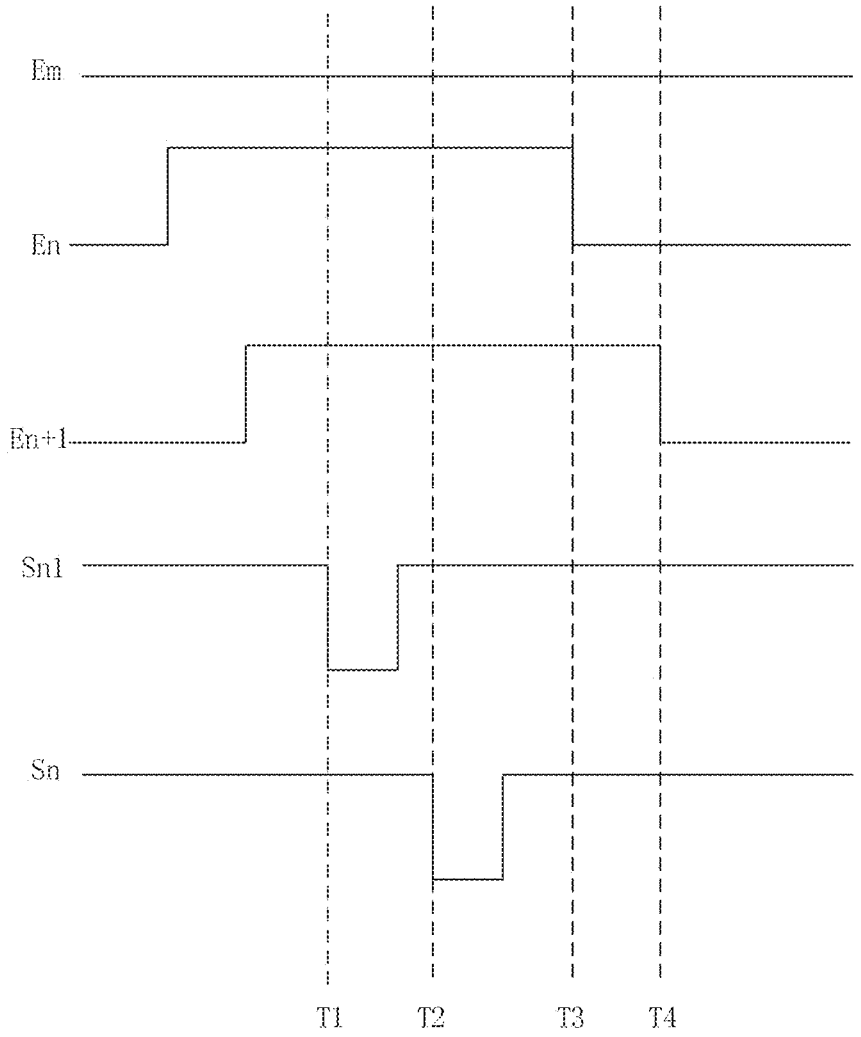
Figure 6:
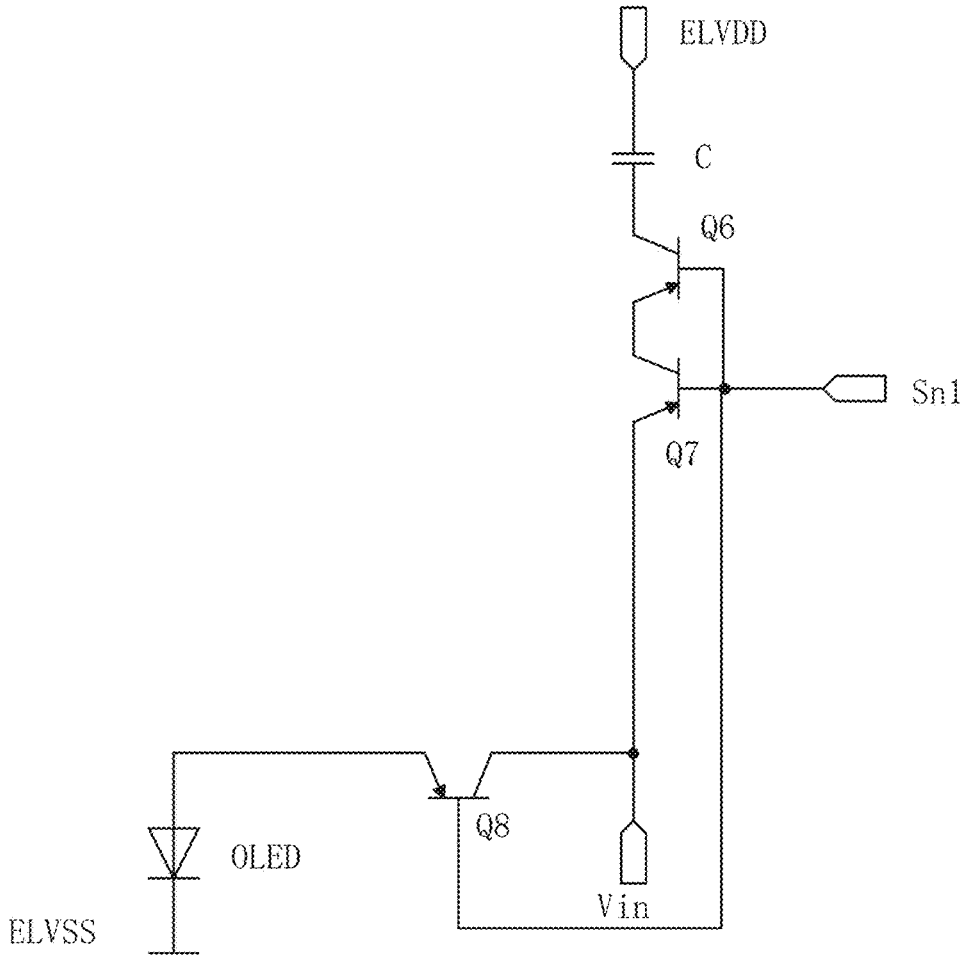
Figure 7:
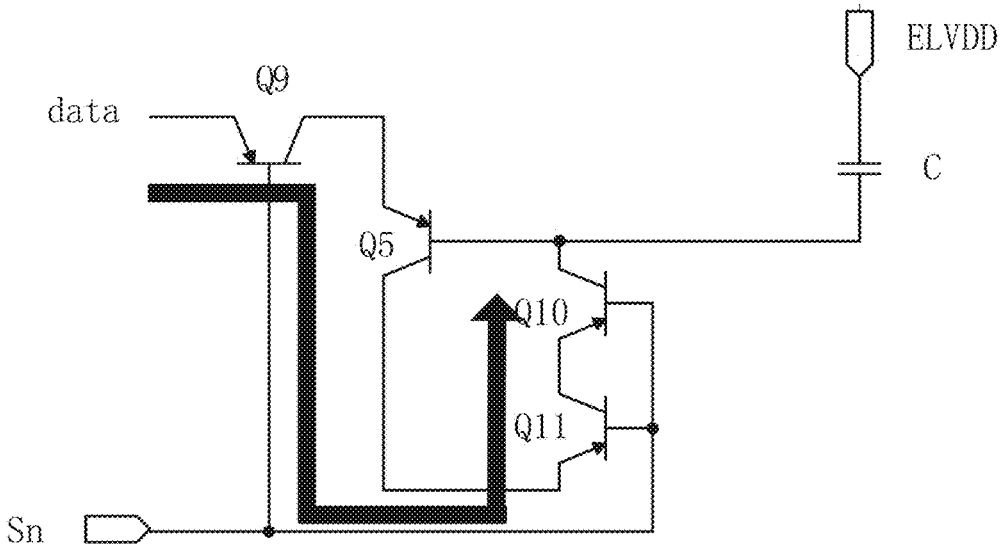
Figure 8:
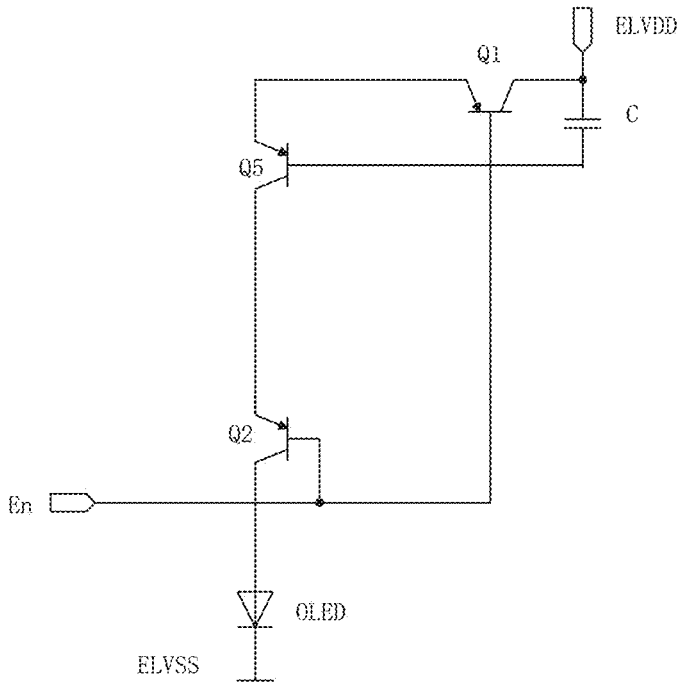
Figure 9A:
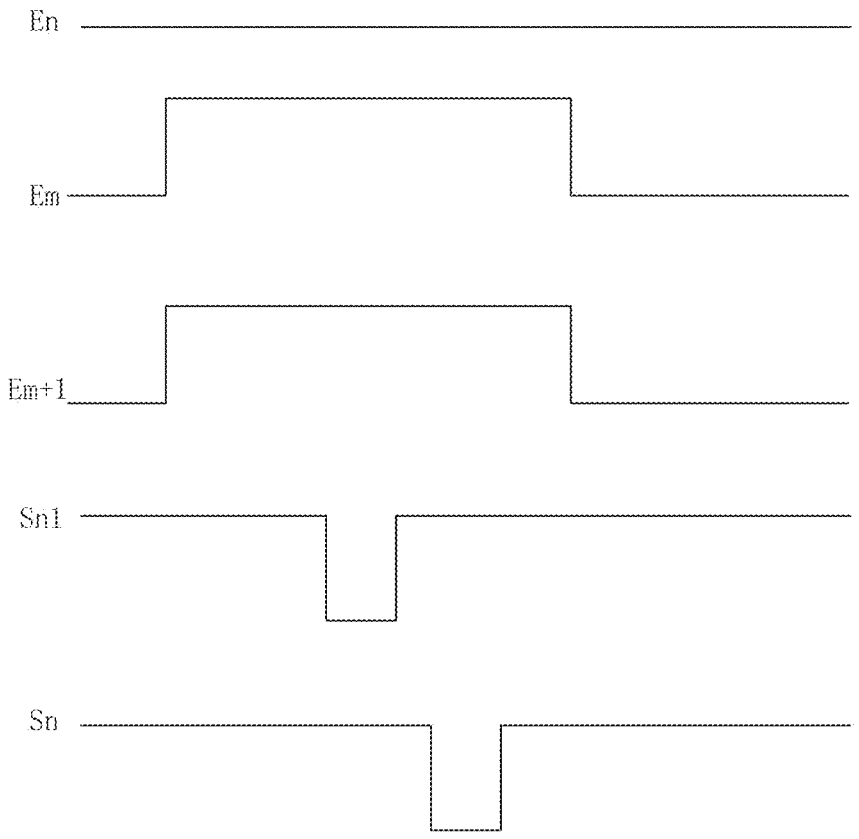
Figure 9B:
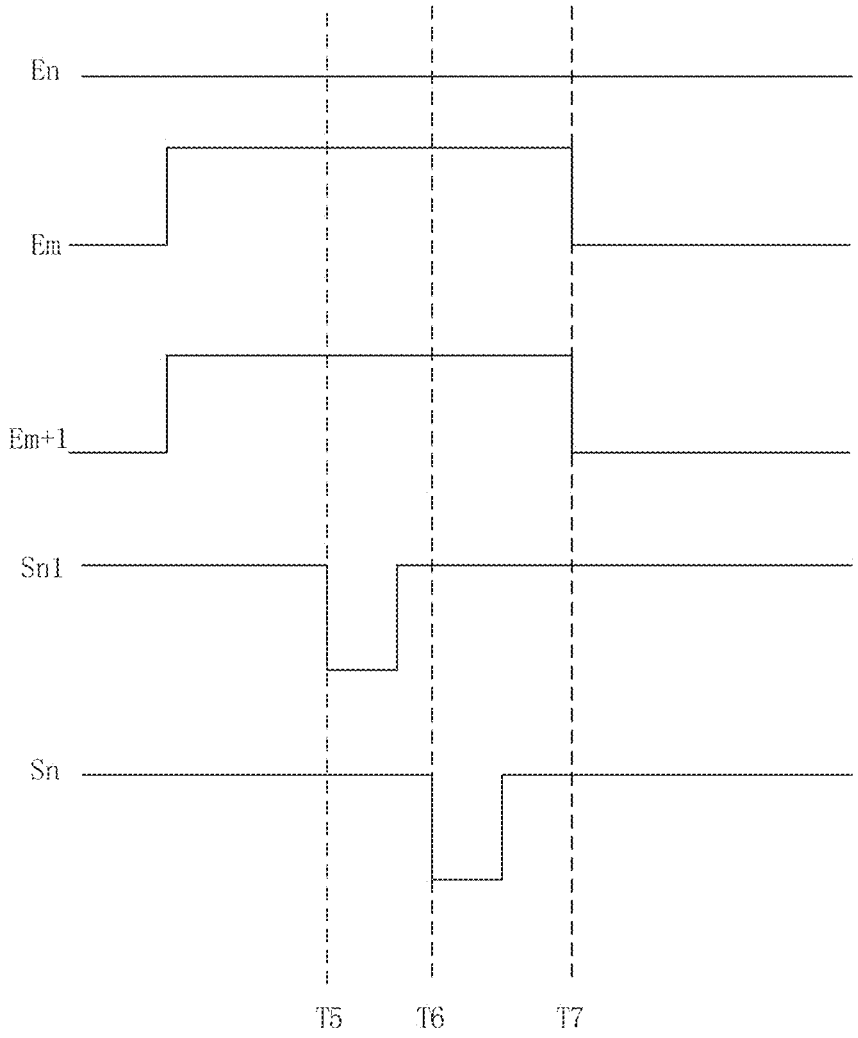
Figure 10:
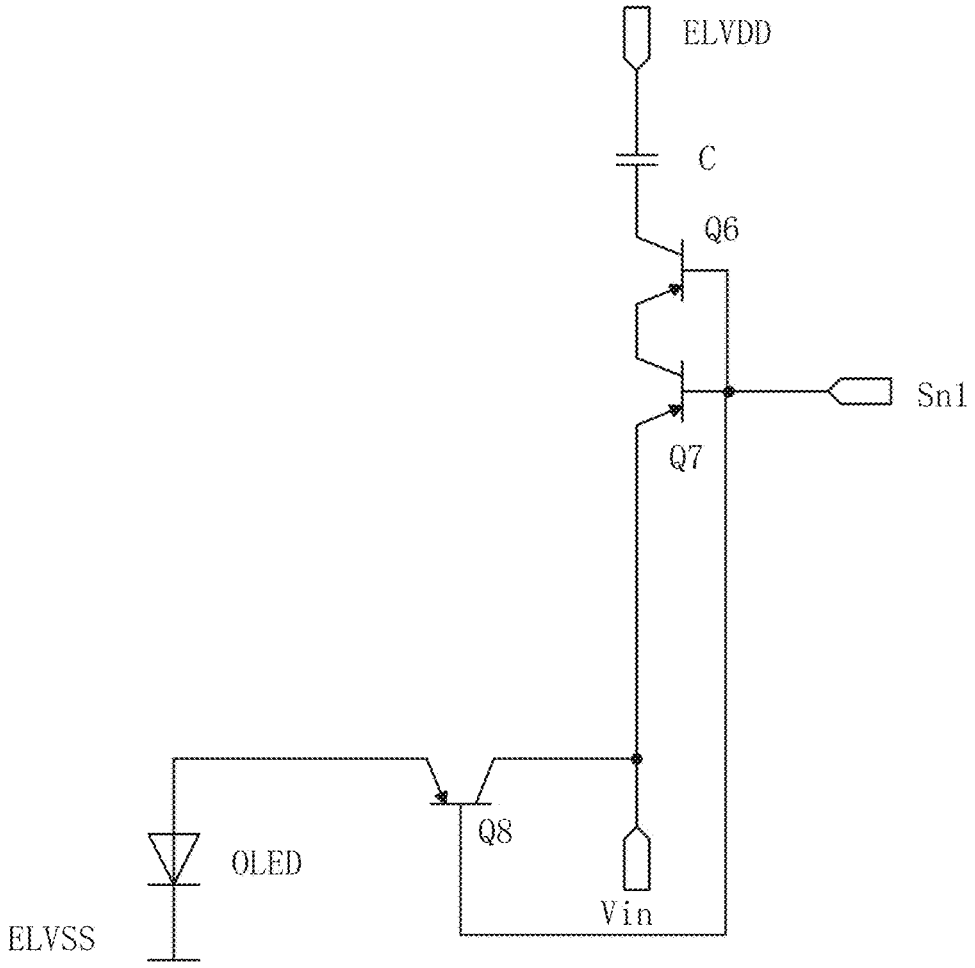
Figure 11:
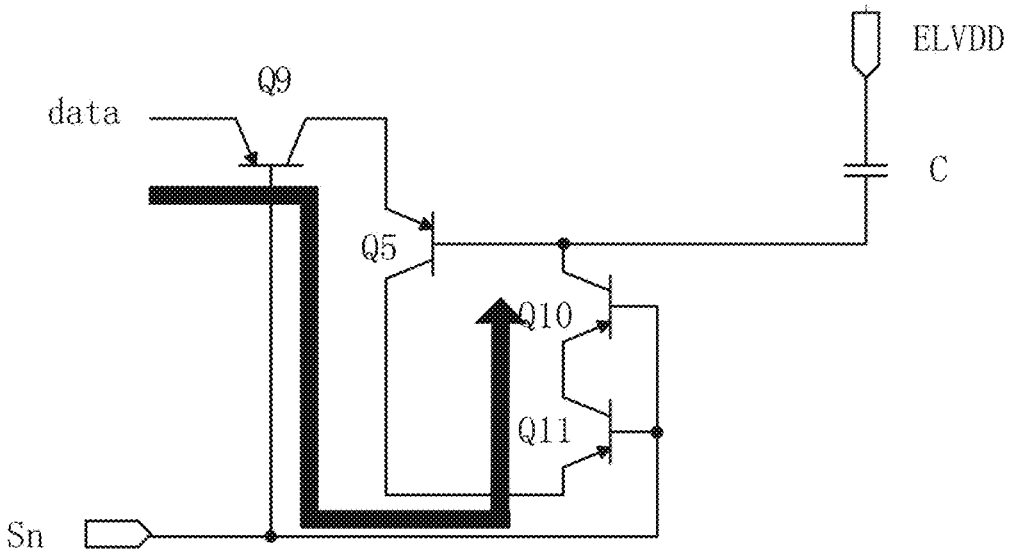
Figure 12:
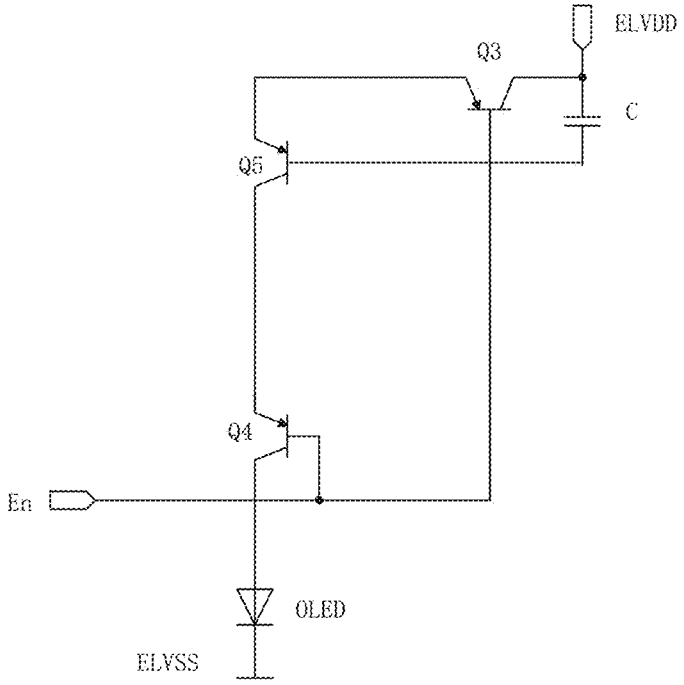

FIGS. 5*a*-5*b* are diagrams of the enable signal and the control signal in the progressive display mode;

FIG. 6 is a circuit diagram of the present invention at time T1;

FIG. 7 is a schematic circuit diagram of the present invention at time T2;

FIG. 8 is a schematic circuit diagram of the present invention at time T3;

FIGS. 9*a*-9*b* are diagrams of the enable signal and the control signal in the multi-line display at the same time mode of the present invention;

FIG. 10 is a schematic circuit diagram of the present invention at time T5;

FIG. 11 is a schematic circuit diagram of the present invention at time T6;

FIG. 12 is a schematic circuit diagram of the present invention at time T7.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

It should be noted that, in the absence of conflict, the following technical solutions, technical characteristics can be combined with each other.

The present invention will now be further described with reference to the accompanying drawings.

Embodiment 1

Figure 1:
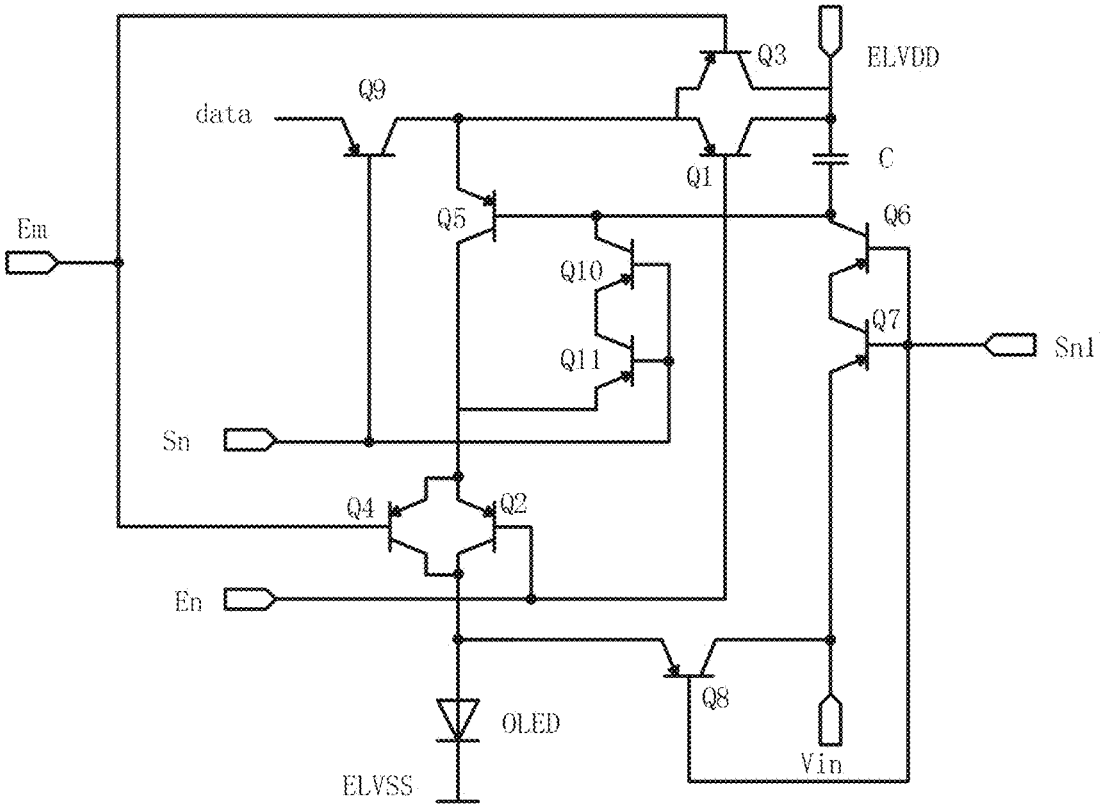
FIG. 1 is a structural diagram of an embodiment of the pixel circuit of the present invention.

The present embodiment provides a pixel array in which the pixel array may include a plurality of multi-row and multi-column pixel circuits, the circuit architecture of each pixel circuit may be the same and the structure diagram of each pixel circuit may be as shown in FIG. 1. The pixel circuit in FIG. 1 can be based on the 7T1C circuit architecture, in which a transistor is connected in parallel to both ends of the two transistors which drive the display device to light, by controlling the corresponding transistor to turn on and off, in order to switch between multiple lines lighting at the same time and line-by-line lighting.

It should be noted that the transistor in the present embodiment may be a thin film transistor, and the following embodiments are illustrated by a thin film transistor as a PMOS transistor. The principle of the NMOS transistor is similar to that of the PMOS transistor and the present embodiment is not described anymore. And the PMOS transistor in the present embodiment includes a first end, a second end and a control end, the first end may be the drain of the PMOS transistor, the second end may be the source of the PMOS transistor, the control end may be the gate of the PMOS transistor.

The pixel circuit of the present embodiment includes a power supply terminal ELVDD, and the power supply terminal ELVDD can provide electric power, in particular, can provide electric power for driving the display device. The display device in this embodiment is an organic light-emitting diode (Organic Light-Emitting Diode, OLED) display devices.

The power supply terminal ELVDD in the present embodiment is connected to the anode of a capacitor C, and the capacitor C is capable of storing the electric power supplied from the power supply terminal ELVDD. The drain of a first MOS transistor Q1 is connected to the power supply terminal ELVDD, the gate of the first MOS transistor Q1 is accessed the first enable signal En which is the driving signal of the line-by-line scan.

The source of a fifth MOS transistor Q5 is connected to the source of the first MOS transistor Q1, the gate of the fifth MOS transistor Q5 is connected to the cathode of the capacitor C, and the drain of the fifth MOS transistor Q5 is connected to the source of a second MOS transistor Q2 Source, and the drain of the second MOS transistor Q2 is connected to the OLED display device, and the gate of the second MOS transistor Q2 is accessed the first enable signal En.

It should be noted that the cathode of the OLED display device in this embodiment may be connected to a reference voltage source ELVSS which may have a reference voltage of zero.

Figure 2:
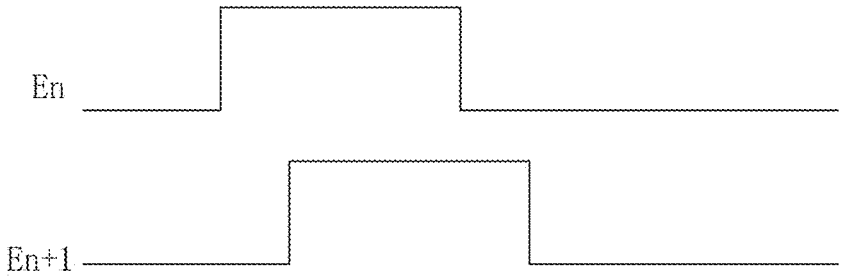
FIG. 2 is a schematic diagram of a first enable signal for each row of the present invention.

FIG. 2 illustrates the first enable signal En. In FIG. 2, En may be the first enable signal which is accessed the first MOS transistor Q1 and the second MOS transistor Q2 of the first row of the pixel circuits, En+1 may be the first enable signal which is accessed the first MOS transistor Q1 and the second MOS transistor Q2 of the second row of the pixel circuits.

As can be appreciated by those skilled in the art, the PMOS transistor can be conducted at a low level, and it can be seen from FIG. 2 that the OLED display device of the first row of the pixel circuits is lit before the OLED display device of the second row of the pixel circuits is lit. Likewise, and the OLED display device of the first row of the pixel circuits is turned off before the OLED display device of the second row of the pixel circuits is turned off. That is, the first enable signal En implements line-by-line scan driver by the above-described method.

In the embodiment, two ends of the first MOS transistor Q1 are connected in parallel with a third MOS transistor Q3, that is, the drain of the third MOS transistor Q3 is connected to the source of the power supply terminal ELVDD, the source of the third MOS transistor Q3 is connected to the source of the first MOS transistor Q1, and the gate of the third MOS transistor Q3 is accessed a second enable signal Em.

The two ends of the second MOS tube Q2 are connected in parallel with a fourth MOS transistor Q4, that is, the source of the fourth MOS transistor Q4 is connected to the source of the second MOS transistor Q2, the drain of the fourth MOS transistor Q4 is connected to the drain of the second MOS transistor Q2, and the gate of the fourth MOS transistor Q4 in the present embodiment is accessed the above-described second enable signal Em.

Figure 3:
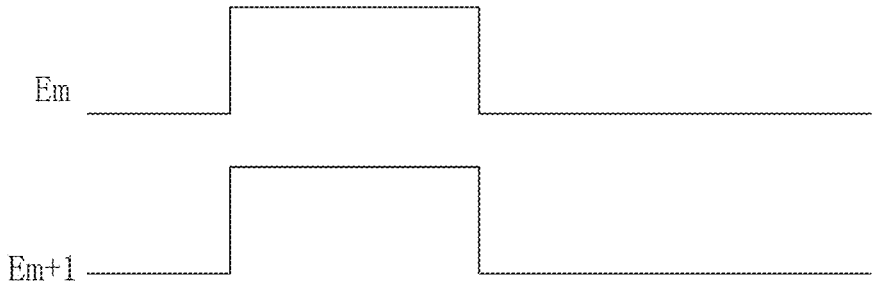
FIG. 3 is a schematic diagram of a second enable signal for each row of the present invention.

The second enable signal Em in the present embodiment is capable of driving the OLED display devices of the multi-row pixel circuits to be lit at the same time, that is, the second enable signal which is accessed the third MOS transistor Q3 and the fourth MOS transistor Q4 in each row of the pixel circuits is the same. As shown in FIG. 3, in the embodiment, Em may be the second enable signal which is accessed the third MOS transistor Q3 and the fourth MOS transistor Q4 of the first row of the pixel circuits, Em+1 may be the second enable signal which is accessed the third MOS transistor Q3 and the fourth MOS transistor Q4 of the second row of the pixel circuits.

It can be seen that the second enable signal accessed the two rows of the pixel circuits is the same, so that the second enable signal can drive the OLED display device of each row of the pixel circuits to light at the same time.

In addition, the pixel circuit in the present embodiment may include a sixth MOS transistor Q6. The drain of the sixth MOS transistor Q6 is connected to the cathode of capacitance C, the gate of the sixth MOS transistor Q6 accesses the first control signal Sn1, the source of the MOS transistor Q6 is connected to the drain of a seventh MOS transistor Q7, and the source of the sixth MOS transistor Q6 is connected to an initial voltage supply terminal Vin which can provide an initial voltage, and the gate of the seventh MOS transistor Q7 accesses the above first control signal Sn1.

In addition, the pixel circuit of the present embodiment includes an eighth MOS transistor Q8. The source of the eighth MOS transistor Q8 is connected to the OLED display device, the drain of the eighth MOS transistor Q8 is connected to the initial voltage supply terminal Vin, the gate of the MOS transistor Q8 accessed the first control signal Sn1. The turn-on and turn-off of the sixth MOS transistor Q6, the seventh MOS transistor Q7, and the eighth MOS transistor Q8 are controlled by the first control signal Sn1, so that the initial voltage can be written into the gate of the fifth MOS transistor Q5.

The pixel circuit in the present embodiment further includes a ninth MOS transistor Q9. The source of the ninth MOS transistor Q9 is connected to a data signal input terminal "data", and the data signal input terminal "data" can be input a data signal, and the drain of the ninth MOS transistor Q9 is connected to the gate of the ninth MOS transistor Q9, the gate of the ninth MOS transistor Q9 accesses a second control signal Sn.

The second control signal Sn is also capable of driving the turn-on and the turn-off of the tenth MOS transistor Q10 and the eleventh MOS transistor Q11. The drain of the tenth MOS transistor Q10 is connected to the cathode of the capacitance C, and the source of the tenth MOS transistor Q10 is connected to the drain of the eleventh MOS transistor Q11, the source of the eleventh MOS transistor Q11 is connected to the source of the second MOS transistor Q2.

Figure 4:
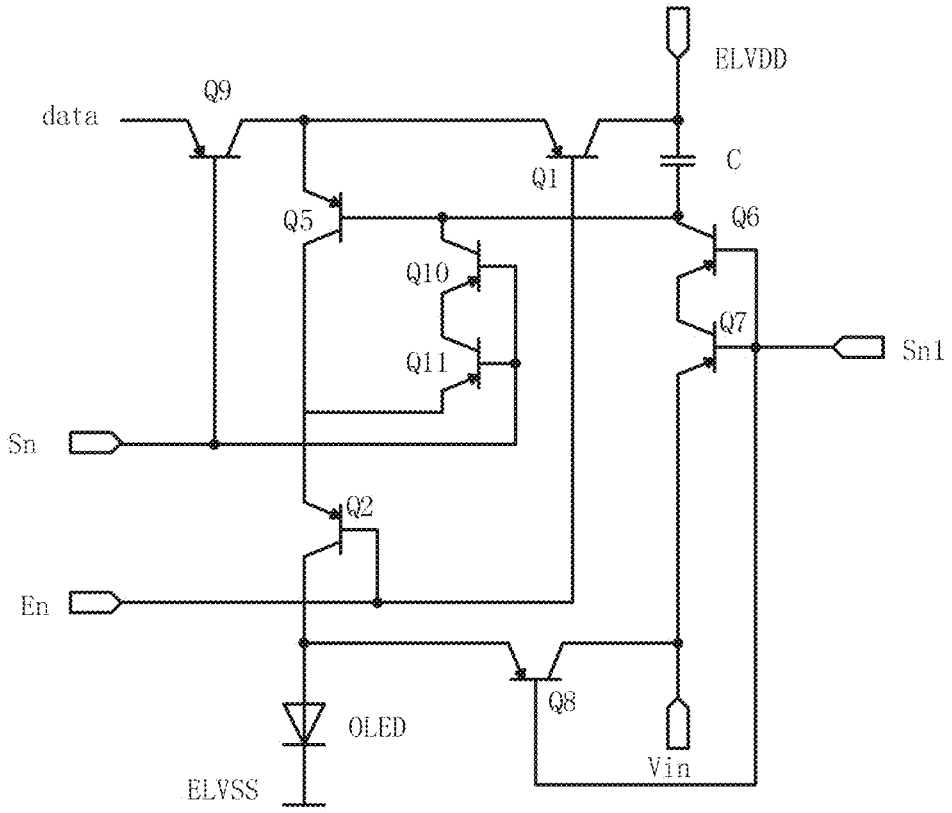
FIG. 4 is a structure diagram of the 7T1C circuit of the present invention.

Based on the above-described circuit connection, the present embodiment will now be described in the normal display state, i.e., the line-by-line display mode. The normal display state assumes that the second enable signal is at a high level, so that the fourth MOS transistor Q4 and the three MOS transistor Q3 are turned off, the corresponding circuit diagram is shown in FIG. 4.

The display principle of the circuit architecture of the 7T1C is as follows:

As shown in FIGS. 5*a* to 5*b*, the second enable signal Em is at a high level, i.e., the third MOS transistor Q3 and the fourth MOS transistor Q4 are turned off, the pixel circuit is line-by-line display mode.

As shown in FIG. 6, at the time T1, Sn1 is at a low level, Sn is at a high level, En is at a high level. At this moment, the sixth MOS transistor Q6 is turned on, the seventh MOS transistor Q7 is turned on, and the eighth MOS Q8 is turned on. The first MOS transistor Q1 is turned off, the second MOS tube Q2 is turned off, the fifth MOS transistor Q5 is turned on, the ninth MOS transistor Q9 is turned off, the tenth MOS transistor Q10 is turned off, and the eleventh MOS transistor Q11 is turned off.

The initial voltage of the initial voltage power source can be written into the cathode of the capacitor C, and the cathode of the capacitor C is connected to the gate of the fifth MOS transistor Q5 so that the written initial voltage enables the fifth MOS transistor Q5 to be turned on.

As shown in FIG. 5*b*, at the time T2, Sn1 is at a high level, Sn is at a low level, En is at a high level. The circuit diagram is shown in FIG. 7, at this moment, the sixth MOS transistor Q6 is turned off, the seventh MOS transistor Q7 is turned off, the eighth MOS transistor Q8 is turned off. The first MOS transistor Q1 is turned off, the second MOS transistor Q2 is turned off, the fifth MOS transistor Q5 is turned on, the ninth MOS transistor Q9 is turned on, the tenth MOS transistor Q10 is turned on, the eleventh MOS transistor Q11 is turned on.

The data signal input from the data signal input terminal "data" can be written in the direction of the arrow, the data signal is successively written through the ninth MOS transistor Q9, the fifth MOS transistor Q5, the eleventh MOS transistor Q11 and the tenth MOS transistor Q10 to the cathode of the capacitor C.

At time T3, Sn1 is at a high level, Sn is at a high level, En is at a low level. The circuit diagram is shown in FIG. 8, at this time, the sixth MOS transistor Q6 is turned off, the seventh MOS transistor Q7 is turned off, the eighth MOS transistor Q8 is turned off. The first MOS transistor Q1 is turned on, the second MOS transistor Q2 is turned on, the fifth MOS transistor Q5 is turned on, the ninth MOS transistor Q9 is turned off, the tenth MOS transistor Q10 is turned off, the eleventh MOS transistor Q11 is turned off.

The power supply voltage of the power supply terminal ELVDD generates a current which flows through the first MOS transistor Q1, the fifth MOS transistor Q5, and the second MOS transistor Q2 successively so that the OLED display device is lit. The time T4 is the lighting time of the next row of the OLED display device, it is seen that each pixel circuit in the pixel array is line-by-line lighting if the second enable signal is at a high level.

In the display mode of multi-line lighting at the same time, it is necessary to keep the first enable signal En at a high level, that is, the first MOS transistor Q1 and the second MOS transistor Q2 is turned off, as shown in FIGS. 9*a* to 9*b*. FIG. 9*a* and FIG. 9*b* are diagrams showing the variation of each control signal and enable signal.

As shown in FIG. 9*b*, at time T5, Sn1 is at a low level, Sn is at a high level, En is at a high level, the circuit diagram at this time is shown in FIG. 8. At this moment, the sixth MOS transistor Q6 is turned on, the seven MOS transistor Q7 is turned on, the eighth MOS transistor Q8 is turned on, the third MOS transistor Q3 is turned off, the fourth MOS transistor Q4 is turned off, the fifth MOS transistor Q5 is turned on, the ninth MOS transistor Q9 is turned off, the tenth MOS transistor Q10 is turned off, the eleventh MOS transistor Q11 is turned off.

The circuit diagram at time T5 is shown in FIG. 10 and the principle is as above. The initial voltage writes into the cathode of the capacitor C through the seventh MOS transistor Q7 and the sixth MOS transistor Q6, the fifth MOS transistor Q5 is turned on as the gate thereof is written into the initial voltage, so as to make the follow-up OLED display device light.

At time T6, Sn1 is at a high level, Sn is at a low level, Em is at a high level, the circuit diagram is shown in FIG. 11. At this time, the sixth MOS transistor Q6 is turned off, the seventh MOS transistor Q7 is turned off, the eighth MOS transistor Q8 is turned off, the third MOS transistor Q 3 is turned off, the fourth MOS transistor Q4 is turned off, the fifth MOS transistor Q5 is turned on, the ninth MOS transistor Q9 is turned on, the tenth MOS transistor Q10 is turned on, the eleventh MOS transistor Q11 is turned on.

The data signal input from the data signal input terminal "data" can be written in the direction of the arrow, the data signal is successively written to the cathode of the capacitor C through the ninth MOS transistor Q9, the fifth MOS transistor Q5, the eleventh MOS transistor Q11 and the tenth MOS transistor Q10.

As shown in FIG. 12, at time T7, Sn1 is at a high level, Sn is at a high level, Em is at a low level. The second enable signal Em controls the third MOS transistor Q3 and the fourth MOS transistor Q4 to be turned on, the supply voltage makes the OLED display device light. As shown in FIGS. 9*a* to 9*b*, the second enable signal Em, which is accessed a plurality of rows of pixel circuits, is the same. Therefore, the OLED display device in the plurality of rows of pixel circuits can be lit at the same time by the driving of the second enable signal Em.

The technical solution of the present embodiment provides two kinds of display modes which can be switched, the display modes are line-by-line display and multi-line display at the same time. It can be seen that the display mode can be switched by changing the first enable signal and the second enable signal. And the light emission time of the OLED display device can be controlled.

Embodiment 2

In the current virtual reality (VR) technology, it is required that the display circuit should display the image, but in the virtual reality, the GI (global insertion) mode is required to be initiated, the GI means that in a frame of time, all the OLED display device in the rows of the pixel circuit is lit at the same time. The pixel array provided by the present embodiment can satisfy the line-by-line display of the ordinary pixel circuit and can also switch to the GI mode described above.

The display circuit of the virtual reality in the present embodiment uses the pixel array in the first embodiment. When the line-by-line display is implemented, the second enable signal is given a high level, so that the second enable signal controls the third MOS transistor and the fourth MOS transistor to be turned off, that is equivalent to the third MOS tube and the fourth MOS tube being removed. The remaining circuit is the circuit of the 7T1C structure, and charging and lighting process is same as the current circuit of the 7T1C structure. The first enable signal is scanned by the rows of the pixel circuits line by line, that is, each row of the pixel circuits corresponds to a driving circuit, and different row of pixel circuits is connected to different driving circuits, so as to realize line-by-line scan of the first enable signal.

In the GI mode, the first enable signal is given a high level, the first enable signal controls the first MOS transistor and the second MOS transistor to be turned off. The second enable signal generated by the driving circuit is output to each of the pixel circuits through a signal line, so that the second enable signal accessed each row of pixel circuits is the same, and the OLED display device in each row of pixel circuits can be lit at the same time by the driving of the second enable signal.

In the above mentioned technical solution, two transistors (i.e., a third transistor and a fourth transistor) are respectively connected in parallel to two ends of the two transistors (i.e., the first transistor and the second transistor) controlled by the first enable signal, and as the enable signal accessed the first transistor and the second transistor is a line-by-line scan, and the enable signal accessed the third transistor and the fourth transistor can drive each of the display devices in the a plurality of rows of pixel circuits to be lit at the same time. By controlling the turn-on and turn-off of the four transistors, it is possible to realize two display modes, which are line-by-line lighting and multi-line lighting at the same time, therefore the display cost of circuit manufacturing is saved and the market share is improved.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A pixel array with two display modes, comprising a plurality of rows of pixel circuits, each of the pixel circuits comprising:

a first transistor comprising a first end connected to a power supply terminal, a second end, and a control end accessing a first enable signal, a second transistor comprising a first end connected to a display device, a second end connected to the second end of the first transistor, and a control end accessing the first enable signal;

a third transistor comprising a first end connected to the power supply terminal, a second end connected to the second end of the first transistor, and a control end connected to a second enable signal; and a fourth transistor comprising a first end connected to the display device, a second end connected to the second end of the second transistor, and a control end accessing the second enable signal;

a fifth transistor comprising a first end connected to the second end of the second transistor, a second end connected to the second end of the first transistor, and a control end connected to the power supply terminal through a capacitor;

a sixth transistor comprising a first end connected to a cathode of the capacitor, a second end, and a control end accessing the first control signal, the capacitor comprising an anode connected to the power supply terminal;

a seventh transistor comprising a first end connected to a second terminal of the sixth transistor, a second end connected to an initial voltage power supply terminal, and a control end accessing the first control signal; and an eighth transistor comprising a first end connected to the initial voltage supply terminal and a second end connected to the display device;

wherein the first transistor and the second transistor are transistors of the same channel type, and the third transistor and the fourth transistor are transistors of the same channel type, and wherein the first enable signal drives the display devices in each row of the pixel circuits to light line by line, and the second enable signal which accesses each row of the pixel circuits is the same so that the second enable signal drives display devices in each row of the pixel circuits to be lit at the same time.

2. The pixel array with the two display modes according to claim 1, wherein the display device is an organic light emitting diode.

3. The pixel array with the two display modes according to claim 1, wherein the first transistor and the second transistor are PMOS transistors.

4. The pixel array with the two display modes according to claim 3, wherein the third transistor and the fourth transistor are PMOS transistors.

5. The pixel array with the two display modes according to claim 1, wherein the fifth transistor, the sixth transistor, the seventh transistor, and the eighth transistor are PMOS transistors.

6. The pixel array with the two display modes according to claim 1, further comprises:

a ninth transistor comprising a first end connected to the second end of the first transistor, a second end connected to a data signal input terminal, and a control end accessing a second control signal;

a tenth transistor comprising a first end connected to the cathode of the capacitor, a second end, and a control end accessing the second control signal; and an eleventh transistor comprising a first end connected to the second end of the tenth transistor, a second end connected to the second end of the second transistor, and a control end of the eleven transistor accessing the second control signal.

7. The pixel array with the two display modes according to claim 6, wherein the ninth transistor, the tenth transistor, and the eleventh transistor are PMOS transistors.

8. A display circuit for virtual reality with two display modes, comprising a pixel array, comprising a plurality of rows of pixel circuits, each of the pixel circuits comprising:

a first transistor comprising a first end connected to a power supply terminal, a second end, and a control end accessing a first enable signal, a second transistor comprising a first end connected to a display device, a second end connected to the second end of the first transistor, and a control end accessing the first enable signal;

a third transistor comprising a first end connected to the power supply terminal, a second end connected to the second end of the first transistor, and a control end connected to a second enable signal; and a fourth transistor comprising a first end connected to the display device, a second end connected to the second end of the second transistor, and a control end accessing the second enable signal;

a fifth transistor comprising a first end connected to the second end of the second transistor, a second end connected to the second end of the first transistor, and a control end connected to the power supply terminal through a capacitor;

a sixth transistor comprising a first end connected to a cathode of the capacitor, a second end, and a control end accessing the first control signal, the capacitor comprising an anode connected to the power supply terminal;

a seventh transistor comprising a first end connected to a second terminal of the sixth transistor, a second end connected to an initial voltage power supply terminal, and a control end accessing the first control signal; and an eighth transistor comprising a first end connected to the initial voltage supply terminal and a second end connected to the display device;

wherein the first transistor and the second transistor are transistors of the same channel type, and the third transistor and the fourth transistor are transistors of the same channel type, and wherein the first enable signal drives the display devices in each row of the pixel circuits to light line by line, and the second enable signal which accesses each row of the pixel circuits is the same so that the second enable signal drives display devices in each row of the pixel circuits to be lit at the same time.

9. The display circuit with the two display modes according to claim 8, wherein the display device is an organic light emitting diode.

10. The display circuit with the two display modes according to claim 8, wherein the first transistor and the second transistor are PMOS transistors.

11. The display circuit with the two display modes according to claim 10, wherein the third transistor and the fourth transistor are PMOS transistors.

12. The display circuit with the two display modes according to claim 8, wherein the fifth transistor, the sixth transistor, the seventh transistor, and the eighth transistor are PMOS transistors.

13. The display circuit with the two display modes according to claim 8, further comprises:

a ninth transistor comprising a first end connected to the second end of the first transistor, a second end connected to a data signal input terminal, and a control end accessing a second control signal;

a tenth transistor comprising a first end connected to the cathode of the capacitor, a second end, and a control end accessing the second control signal; and an eleventh transistor comprising a first end connected to the second end of the tenth transistor, a second end connected to the second end of the second transistor, and a control end of the eleven transistor accessing the second control signal.

14. The display circuit with the two display modes according to claim 13, wherein the ninth transistor, the tenth transistor, and the eleventh transistor are PMOS transistors.

* * * * *